US007493729B1

(12) United States Patent
Semmes

(10) Patent No.: US 7,493,729 B1
(45) Date of Patent: Feb. 24, 2009

(54) ROOFTOP ENCLOSURE

(76) Inventor: Thomas Middleton Semmes, 17276 SE. Parkers Dr., Gladstone, OR (US) 97027

( * ) Notice: Subject to any disclaimer, the term of this patent is extended or adjusted under 35 U.S.C. 154(b) by 313 days.

(21) Appl. No.: 11/376,543

(22) Filed: Mar. 15, 2006

(51) Int. Cl.

| | |
|---|---|
| ***E04B 1/00*** | (2006.01) |
| ***E04B 5/00*** | (2006.01) |
| ***E04B 7/00*** | (2006.01) |
| ***E04C 2/32*** | (2006.01) |
| ***E04C 2/54*** | (2006.01) |
| ***E04C 3/00*** | (2006.01) |
| ***E04C 3/30*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/79.1; 52/198; 52/284; 52/579; 52/783.11

(58) Field of Classification Search ..... 52/79.1, 52/169.12, 198, 200, 262, 284, 579, 783.11
See application file for complete search history.

(56) References Cited

U.S. PATENT DOCUMENTS

| | | | | | |
|---|---|---|---|---|---|
| 3,113,401 | A * | 12/1963 | Rose | ..... | 52/417 |
| 3,274,739 | A * | 9/1966 | Gregoire | ..... | 52/155 |
| 3,733,232 | A * | 5/1973 | Payne | ..... | 156/79 |
| 3,773,232 | A * | 11/1973 | Hidding | ..... | 222/480 |
| 4,475,327 | A * | 10/1984 | O'Regan et al. | ..... | 52/404.1 |
| 6,085,485 | A * | 7/2000 | Murdock | ..... | 52/783.19 |
| 6,321,504 | B1 * | 11/2001 | Svensson | ..... | 52/650.1 |
| 2004/0134162 | A1 * | 7/2004 | Douglas | ..... | 52/741.1 |

* cited by examiner

*Primary Examiner*—Brian E. Glessner
*Assistant Examiner*—Branon C Painter
(74) *Attorney, Agent, or Firm*—Mark S. Hubert

(57) ABSTRACT

The present invention relates to an improved commercial rooftop enclosure that utilizes a roof and wall panel design incorporated with structurally bent rails connecting the panel assemblies to each other and to a corrugated panel steel base. This forms the enclosure into a torsion box style building wherein the strength of the enclosure is derived from its overall "unibody" style construction. With this design the rooftop enclosure offers a lower overall profile, reduced weight and increased structural strength over its conventional counterparts.

1 Claim, 10 Drawing Sheets

ROOFTOP ENCLOSURE

FIELD OF THE INVENTION

The present invention relates to an improved commercial rooftop enclosure. More specifically, it relates to a new torsion box design for a rooftop enclosure that adds additional strength while minimizing the overall height and weight of the unit.

BACKGROUND

Commercial rooftop A/C units, chillers and pre-fabricated penthouses have enclosures that house, protect, support and integrate the A/C and/or mechanical components into the building structure. These enclosures are quite large. These enclosures must be light enough to fall within building roof loading limits and seismic regulations, strong enough to withstand distortion under craning operations and wind loads, and maintain as low a profile as possible to minimize wind loads as well as the visual impact of the monstrous eyesores.

The conventional enclosure designs attach a paneled wall and roof structure, made from a plurality of mechanically connected flat panels and corner panels, atop a planar base platform. The base platform is made of steel deck plate affixed atop a frame of thick structural steel members and cross members. Since these huge enclosures must be raised onto a rooftop by a crane, distortion is a problem. Because of the square footage of the enclosure's sides, distortion from wind loading is also a problem. The base, to serve as the strength to unify the enclosure and resist distortion, requires thick structural members having substantial height below the deck plate, increasing the overall enclosure height and weight. This type of construction is in direct opposition with the roof loading/seismic requirements and the overall aim of a lowered enclosure height. Simply stated, height and weight must be minimized in these structures and strength must be maximized.

The present invention utilizes a roof and wall panel design that has corrugated or formed and bent "C" profile panels with increased structural strength. The present invention also has a corrugated panel metal base that eliminates the massive structural steel requirement. Rails that are adapted for the connection of the walls to the base, and the roof to the walls, allow for the strength of the enclosure to derive from its overall "unibody" style construction rather than from connection to a stout base. The present invention enclosure forms a strong torsion box that has a lower overall profile, reduced weight and increased strength.

Such design innovations as the present invention provides, overcome the pitfalls of the prior art and is a cost effective, simple solution that avoids the aforementioned pitfalls of the prior art.

SUMMARY OF THE INVENTION

The general purpose of the present invention, which will be described subsequently in greater detail, is to provide an economical, lightweight, rigid, low profile, rooftop unit enclosure that will be easily located onto a building rooftop while withstanding the stresses and strains of such relocation without encountering any non-elastic deforamtion of the enclosure.

It has many of the advantages mentioned heretofore and many novel features that result in a new, lightweight, strong, height minimized outdoor enclosure which are not anticipated, rendered obvious, suggested, or even implied by any of the prior art, either alone or in any combination thereof.

In accordance with the invention, an object of the present invention is to provide an improved outdoor enclosure that has a lowered height profile to minimize wind load.

It is another object of this invention to provide an improved enclosure that offers substantial structural rigidity while minimizing weight.

It is a further object of this invention to provide an improved lightweight outdoor or indoor enclosure that is simple and economical to construct.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DESCRIPTION

Figure 1:
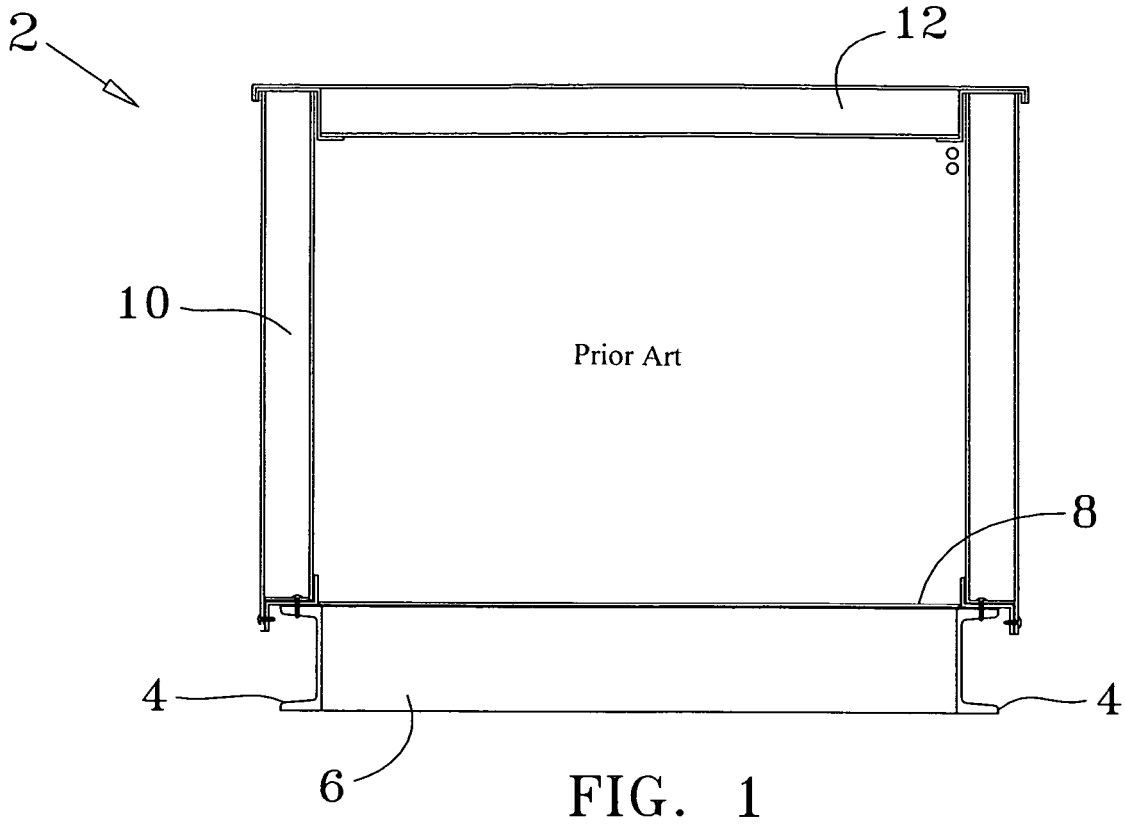
FIG. 1 is a cross sectional end view of a conventional commercial rooftop enclosure.
Figure 2:
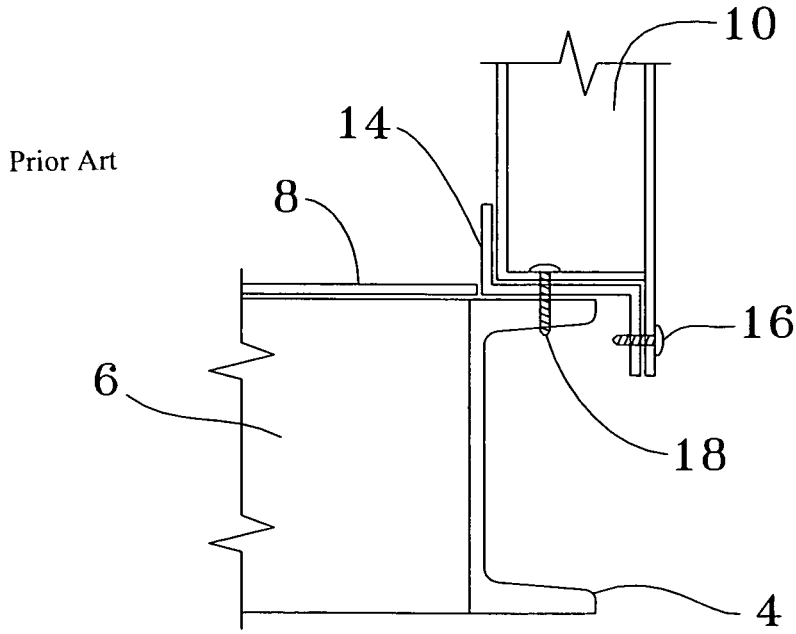
FIG. 2 is a cross sectional end view showing the wall to base connection in a conventional commercial rooftop enclosure.
Figure 3:
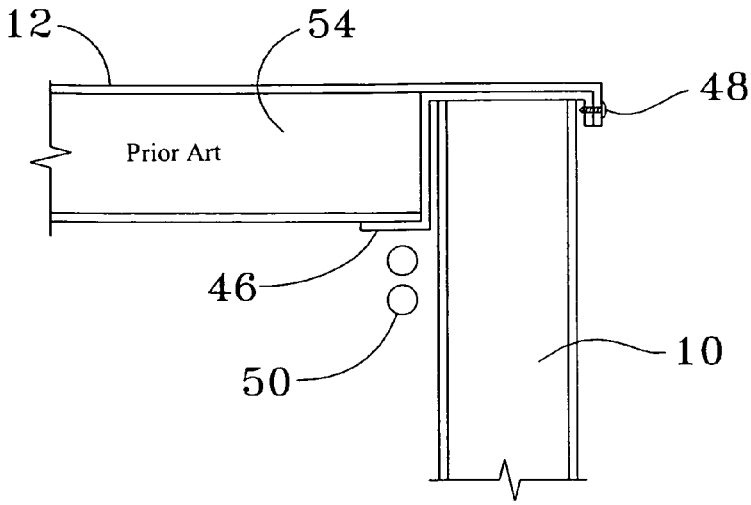
FIG. 3 is cross sectional end view showing the roof to wall connection in a conventional commercial rooftop enclosure.
Figure 4:
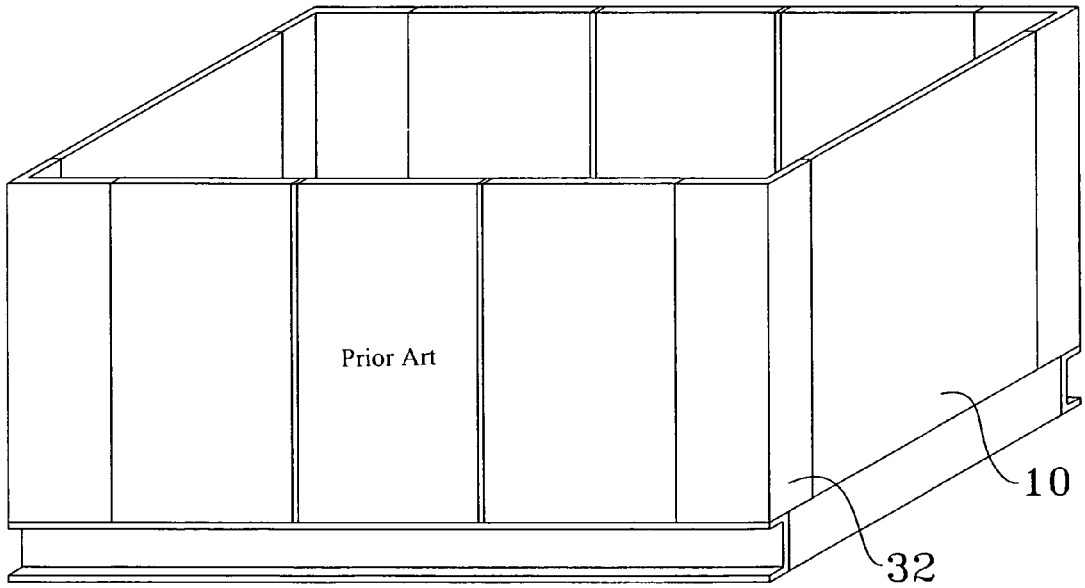
FIG. 4 is a perspective side view of a conventional commercial rooftop enclosure without a roof.

The present invention relates to a commercial rooftop enclosure that utilizes a new unibody, torsion box design that offers significant increases in strength while reducing the overall weight and height.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The improvements and innovations of the present invention can best be seen in relation to the existing limitations of the prior art. FIGS. 1-4 illustrate the construction and assembly of a conventional commercial rooftop A/C enclosure.

Conventional enclosure 2 has a base made of two structural "C" channels 4 mechanically affixed, generally by welding, to a plurality of structural cross members 6 so as to form a support structure for planar floor 8. Channel 4, cross member 6 and floor 8 are made of steel. Wall panels 10 carry the weight of roof panels 12 down onto channels 4 and are connected to the base by lower "Z" rails 14. First mechanical fasteners 16 attach wall panels 10 to lower "Z" rail 14 and second mechanical fasteners 18 connect lower "Z" rail to channel 4. Roof panel 12 is connected to wall panel 10 in a similar fashion using top "Z" rail 46 with third mechanical fastener 48. Electrical conduits 50 are run along the roof/wall interface and held there unprotected by an appropriate means of attachment. Roof panels 12 are of an overlapping rainproof design which is well known in the art. Multiples of the wall panels 10 are connected to form the walls. Adjacent wall panel assemblies are connected by corner wall panels 32. The roof panels 12 and wall panels 10 are of a box style steel construction having a hollow centrally enclosed cavity 54. The floor 8 is of steel deck plate. The coupling of multiples of wall panels 10 and roof panels 12 can be accomplished by any of a number of mechanical fastening means, most commonly though, is by crimping, screws or nuts and bolts.

Since these enclosures 2 have to be raised onto the building roof by crane, they are subject to a plethora of unbalanced forces in this process. This requires the enclosure 2 to have a suitable level of rigidity. The strength of the conventional enclosure arises from its base and the heavy structural members that are used. The floor 8 serves to strengthen the base's rectangularity, preventing the base from "racking" into a trapezoid. The strength required for conventional enclosure bases requires that the "C" channels 4 and structural cross members 6 are thick. This raises the overall height of the enclosure 2 thereby subjecting it to higher wind loads, adds additional mass to the roof, affects seismic considerations, and increases visibility of what can be generally considered an eyesore. The number and spacing of cross members 6 varies with the actual floor 8.

The present invention of a rooftop enclosure utilizes a system of structural base, wall and roof panels tied together by structural rails. The overall structure forms a torsion box, unibody construction with at least two top rails connecting the roof panel system to the wall panel system and four bottom rails connecting the floor panel system to the wall panel system. The following description details each of the floor, wall and roof panel systems as well as the rails that join these systems and give strength to this torsion box design.

Figure 5:
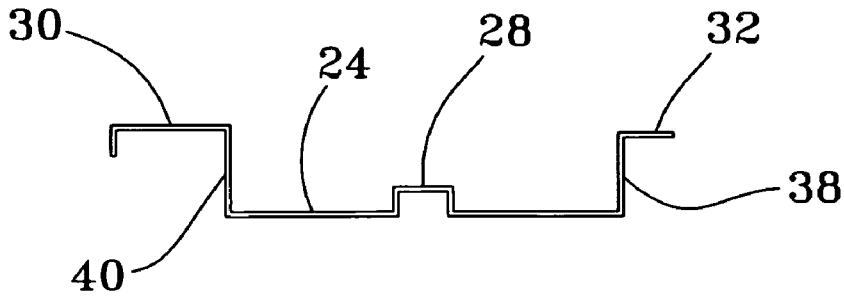
FIG. 5 is a cross sectional view of the floor panel top plate taken normal to its longitudinal axis.
Figure 6:
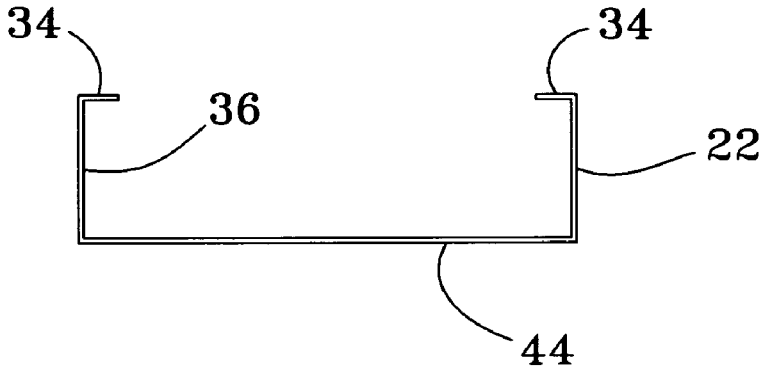
FIG. 6 is a cross sectional view of the floor panel bottom plate taken normal to its longitudinal axis.
Figure 7:
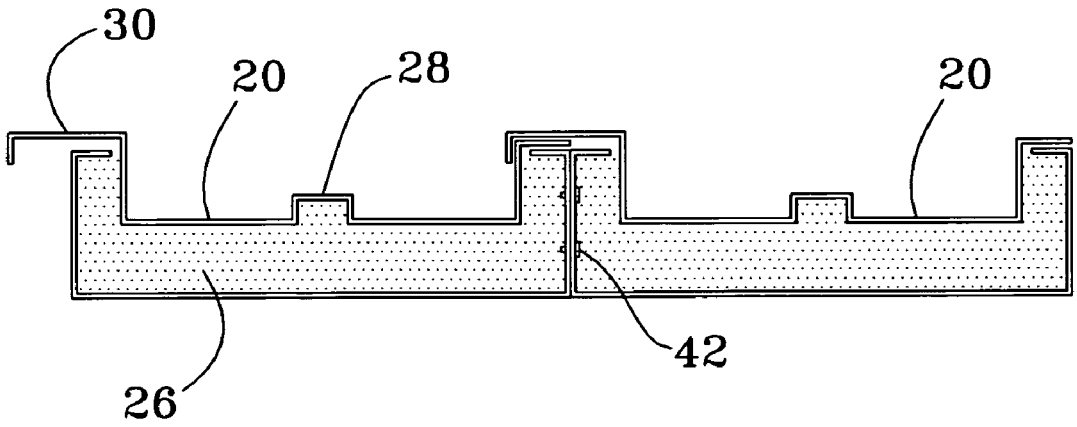
FIG. 7 is a cross sectional view of two assembled floor panels that have been connected and filled with foam insulation taken normal to its longitudinal axis.

Looking at FIGS. 5, 6 and 7 the general arrangement of a floor panel 20 and the manner of joining two or more floor panels can be best seen. Floor panel 20 is a linear member formed from a longitudinally symmetrical "C" channel 22, and a corrugated top panel 24, that are adhered together after the injection of an expanding, adhesive foam core 26 between these panels. Top panel 24 has a concave configuration with two flanges extending normally outward from the top linear edge of its parallel sides 38. Channel 22 has a concave configuration with two substantially similar flanges 34 extending internally and normal from the top linear edge of its parallel sides 36. The concavity of top panel 24 resides inside the concavity of "C" channel 22. Insulating adhesive foam 26 holds channel 22 and top panel 24 together.

Top panel 24 is not symmetrical about its longitudinal axis. It has a depth of corrugation and a raised profile 28 along its longitudinal axis to impart strength and rigidity. First side 38 of top panel 24 has a flange 32 extending outward and normal. The opposing second side 40 of top panel 24 has a cap flange 30 also extending outward and normal but is formed into an interlocking cap that is dimensioned so as to reside atop of first flange 32 of an adjacently positioned floor panel 20. Adjacent floor panels 20 are connected by mechanical fasteners 42 that pass through abutting sides 36. These fasteners 42 are applied before panel 20 is fully assembled and foam 26 installed. Although not illustrated, it is known that the method of mechanical fastening by crimping together the metal of adjacent panels is an acceptable, commonly used alternative to the use of nuts and bolts, screws, rivets, pins etc.

Figure 8:
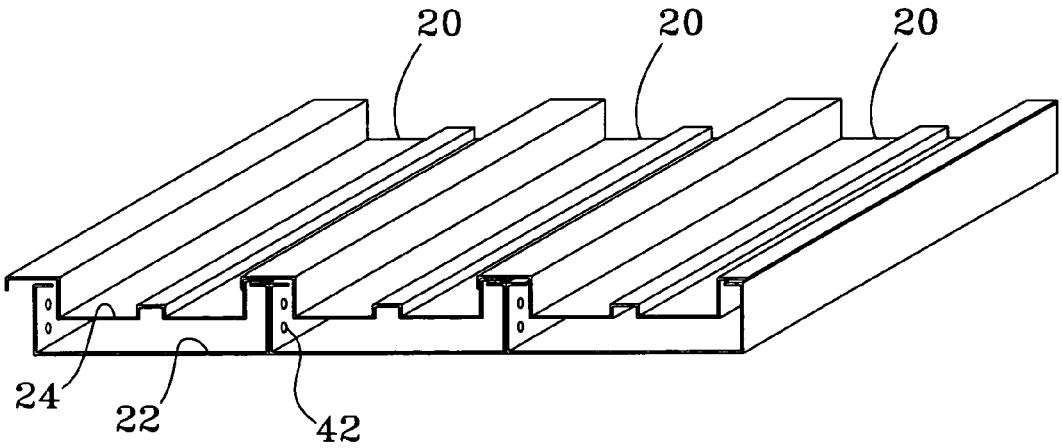
FIG. 8 is a perspective view of three connected floor panels before foam insulation injecting.

FIG. 8 shows a perspective side view of three connected floor panels 20 prior to the injection of insulating adhesive foam 26. It is a notable distinction between the base of the present invention (formed from connected multiple floor panels) and the base of a conventional rooftop unit, that the base of the present invention has a smooth, planar bottom surface 44 and a corrugated upper surface which is shaped into folds or parallel and alternating ridges and grooves. This design is an inversion of the conventional bases, which have smooth, planar upper surfaces and ribbed or corrugated bottom surfaces. This smooth bottomed configuration allows for flexibility when installing and locating A/C enclosures on rooftop curbs. It is known that the floor panel assembly may be installed upside down as required in certain configurations. Still in other configurations the corrugation may be incorporated onto channel 22, or the smooth surface may be incorporated onto top panel 24.

Insulating adhesive foam 26, as used in the ceiling and floor panel systems, is well known in the industry and commonly known as polyurethane foam. It has a volatile fluorocarbon content, is best suited for applications not exposed to sunlight and generally has a closed cell content of 85 to 95%.

Figure 9:
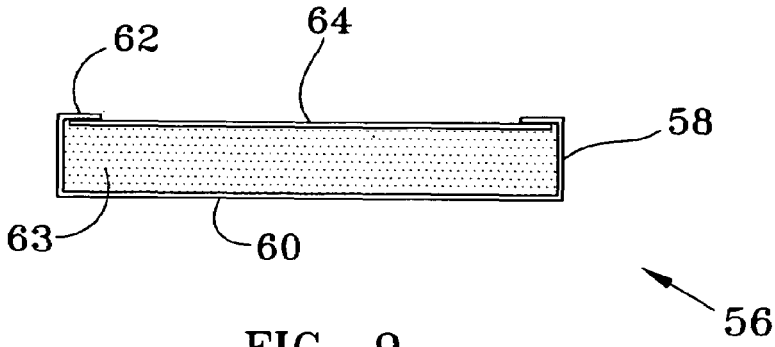
FIG. 9 is a cross sectional view of a single wall panel taken normal to its longitudinal axis.
Figure 16:
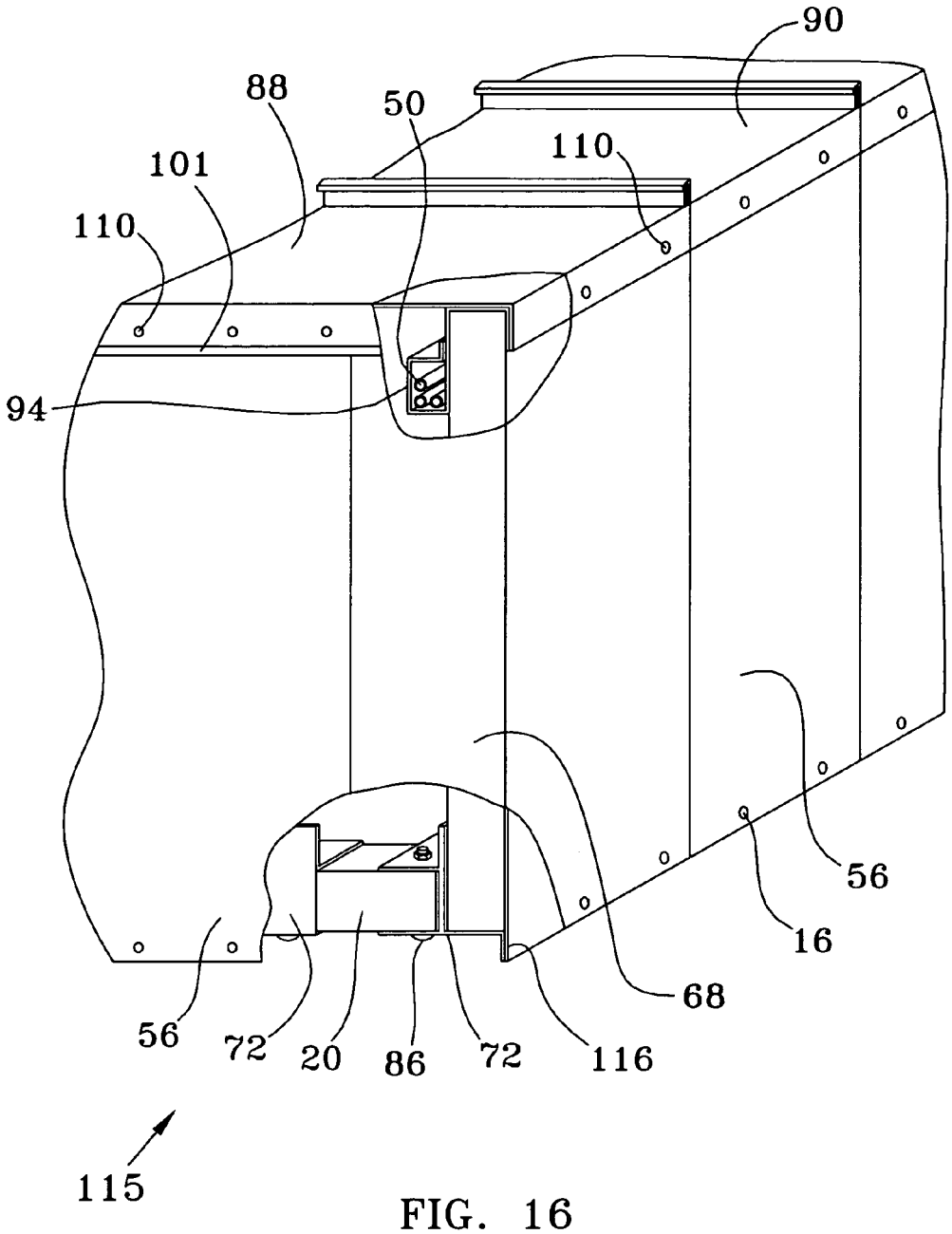
FIG. 16 is a partial cutaway perspective view of the rooftop enclosure, showing the wall, roof and floor rails and attachments.

As can be seen in FIG. 9, a cross section of a wall panel taken through its longitudinal axis, steel wall panel 56 has been formed into a "C" shape so as to have two sidewalls 58 that extend normally from a planar outer face 60. Flanges 62 extend inward toward the concavity created by the panel 56. Bat insulation 63 is placed within the panel's concavity and a panel plate 64 is friction fit into the assembly so as to form a planar panel 56 which is rectangular in cross section. The outer face 60 of each panel is longer than the sidewalls 58 and the panel plate 64 so as to form a connecting and weatherproofing lip 116 (FIG. 16).

Figure 10:
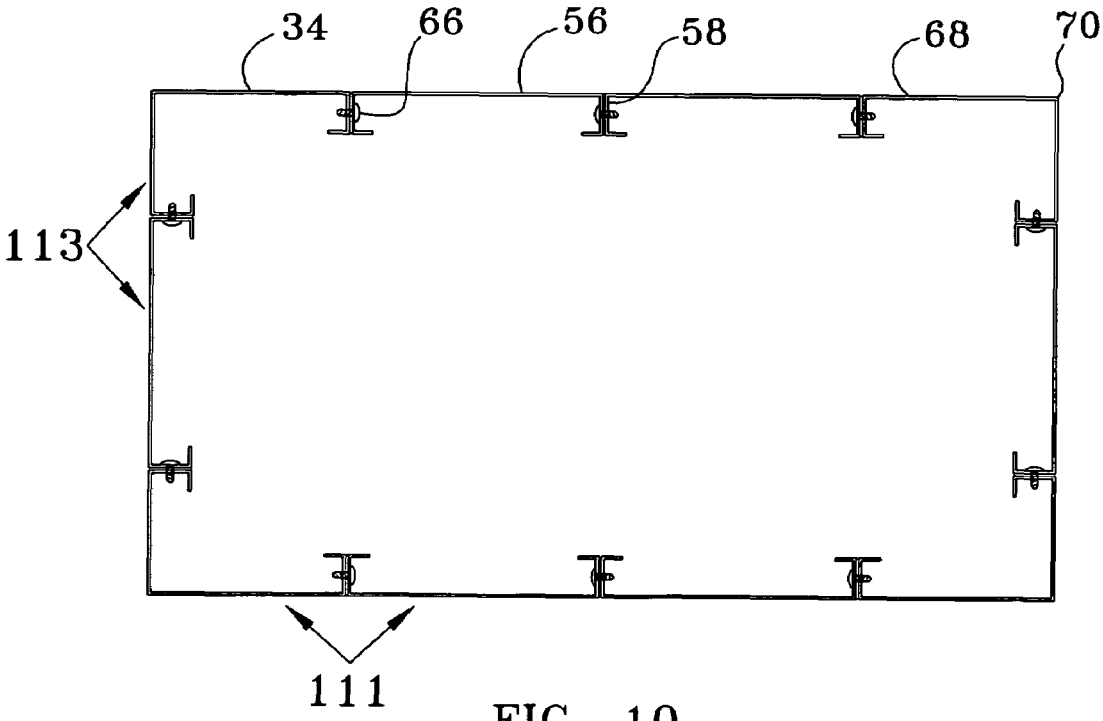
FIG. 10 is a top cross sectional view of the rooftop enclosure without panel plates installed.

Looking at FIG. 10 the top cross sectional view of the rooftop enclosure without panel plates installed, can be seen. Wall panels 56 are mechanically fastened together at their adjacent sidewalls 58 by mechanical fasteners 66. Corner panels 68 differ from panels 56 only by the introduction of a 90 degree bend 70.

Figure 11:
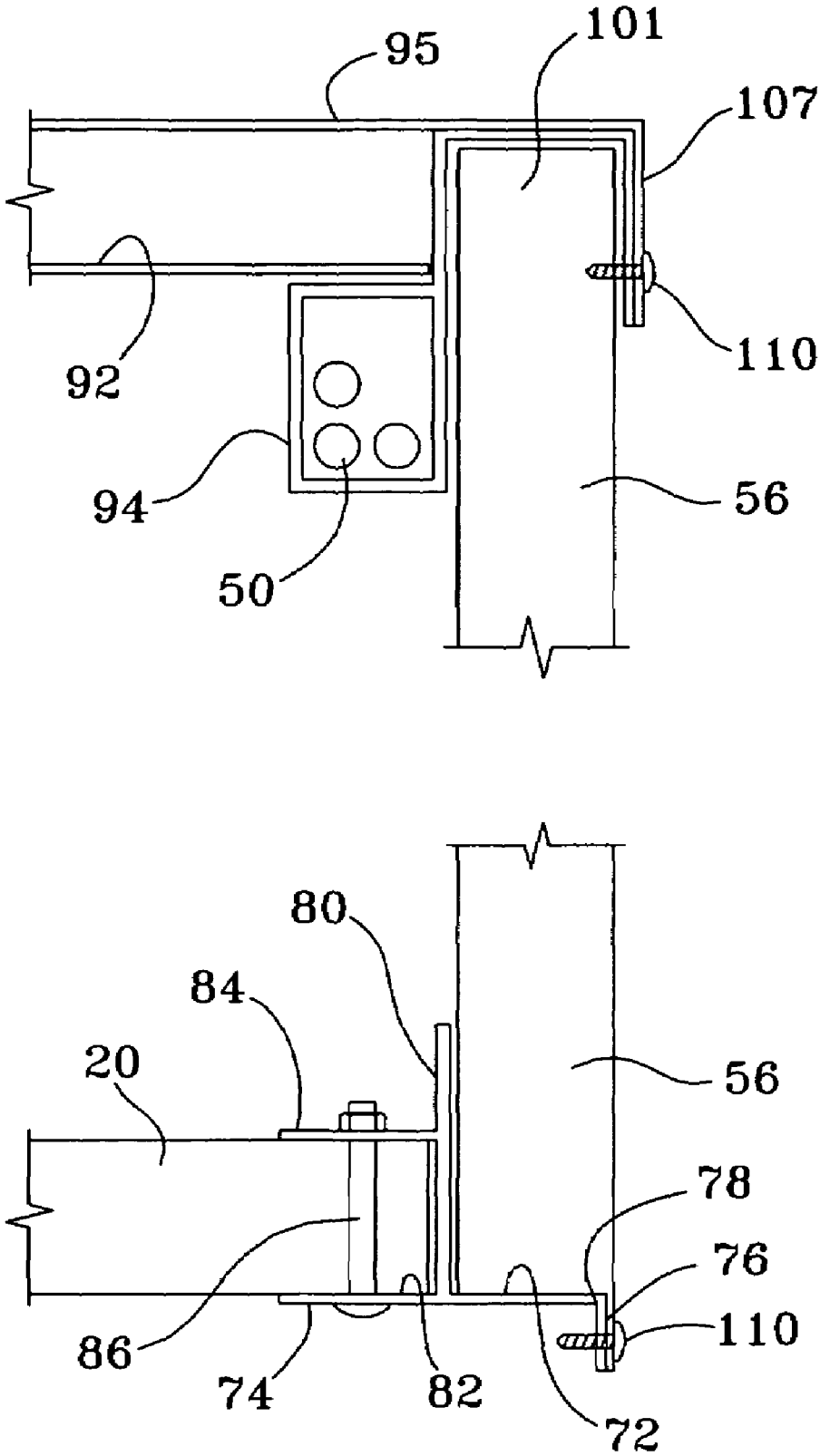
FIG. 11 is a partial cross sectional end view of the rooftop enclosure, showing the wall, roof and floor rails and attachments.
Figure 12:
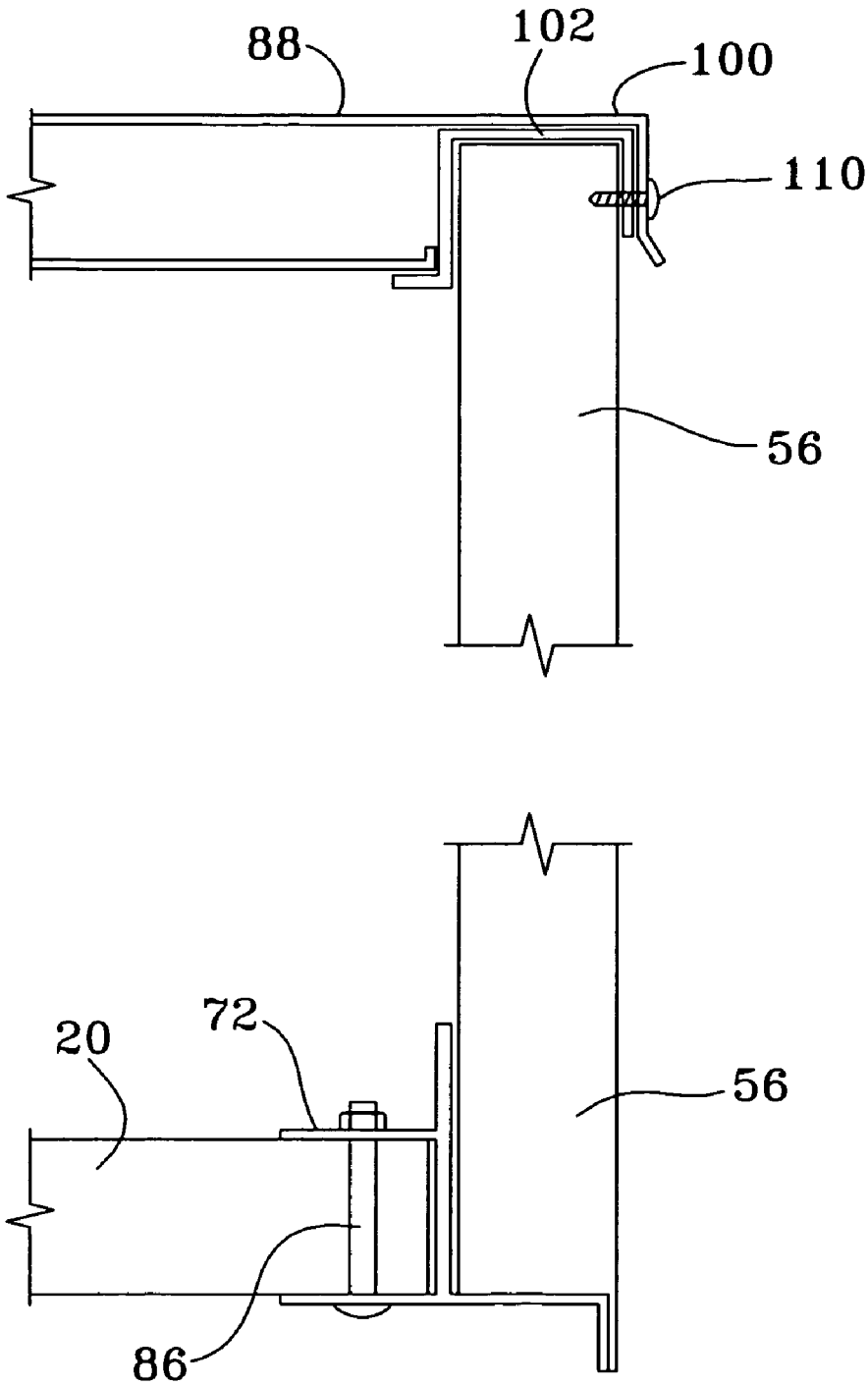
FIG. 12 is a partial cross sectional side view of the rooftop enclosure, showing the wall, roof and floor rails and attachments.

Looking at FIG. 11 the method of joining floor panel 20 to wall panel 56 can best be seen. Bottom rail 72 is an extruded steel member of a bottom plate 74 with a flange 76 projecting normally from its lower face bottom edge 78 and a riser plate 80 projecting normally from the approximate midpoint of its upper face 82. The riser plate 80 has a secondary plate 84 extending normally therefrom that resides parallel to bottom plate 74. Floor panel 20 resides between bottom plate 74 and secondary plate 82 while abutting to riser plate 80. It is held in this position by mechanical fastener 86. Wall panel 10 is mechanically fastened to flange 76 by fastener 110. In this way wall panel 10 is held secured and normal to floor panel 20. There are four bottom rails 72 utilized as can be seen in FIG. 11's end view cross section and FIG. 16's partial cutaway sections.

Figure 13:
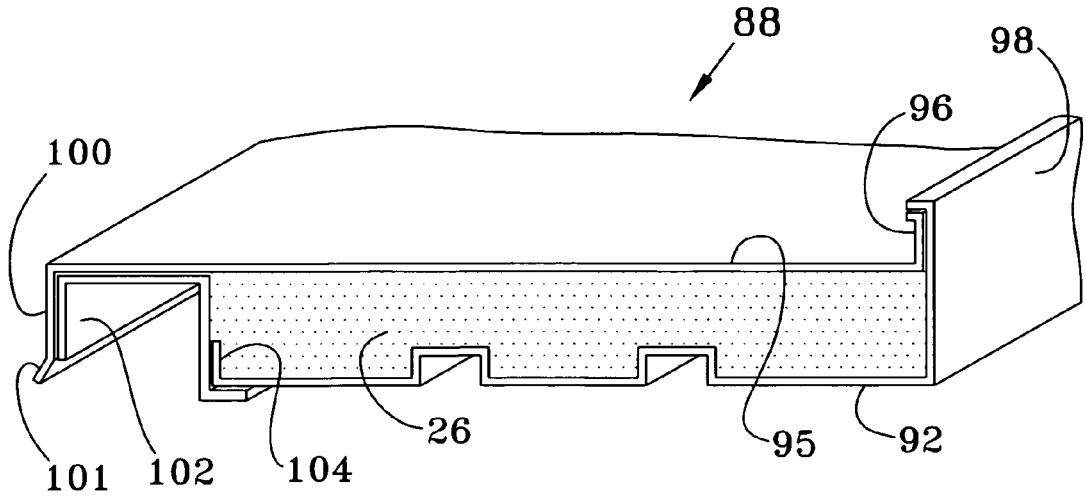
FIG. 13 is a cross sectional perspective view of an end roof panel taken normal to its longitudinal axis.
Figure 14:
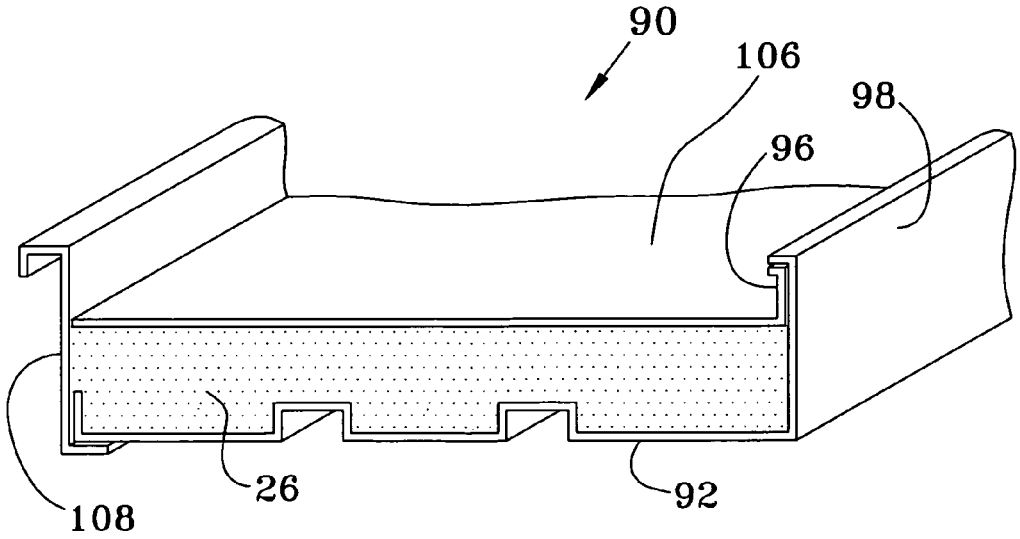
FIG. 14 is a cross sectional perspective view of a 30 center roof panel taken normal to its longitudinal axis.

The roof panel system can best be seen and explained by reference to FIGS. 13, 14 and 15. The roof panel system is made of corrugated end panels 88 and corrugated center panels 90. Each of these panels is made of numerous extruded plates held together by adhesive insulating foam 26. All panels are of an interlocking design so as to be connected between their nestled inner 96, middle 98 and outer drip flanges 108 by any of a plethora of mechanical fasteners 93 including but not limited to screws, nuts and bolts, pins, rivets and cinchlocks. The design incorporates three waterproof lips to retard rain ingress between joined roof panels, between the end walls and the roof panels, and between the side walls and the roof panels.

End panel 88 has bottom corrugated plate 92 held in a spaced, parallel planar configuration with first top plate 95 by adhesive insulating foam 26. First top plate 95 has a short inner drip flange 96 at a proximate edge, extending normally from its top surface, that resides adjacent to and abuts long middle drip flange 98 which projects normally from the proximate edge of bottom corrugated plate 92. The distal edge of top plate 95 has a cap flange 100 extending normally from its bottom surface. Cap flange 100 has a flared lip 101 to direct away rain. Cap plate 102 is a "C" shaped channel that bridges the gap between cap flange 100 and the distal edge 104 of bottom corrugated plate 92. The trough formed by cap flange 100 accommodates the end wall panels 56 and 68, thereby forming a drip proof end wall to roof enclosure.

Center panel 90 has bottom corrugated plate 92 held in a spaced, parallel, planar configuration with second top plate 106 by adhesive insulating foam 26. Second top plate 106 has a short inner drip flange 96 at a proximate edge, extending normally from its top surface, that resides adjacent to and abuts long middle drip flange 98 which projects normally from the proximate edge of bottom corrugated plate 92. This drip flange design is identical on both the end panel 88 and the center panel 90. Outer drip flange 108 abuts the distal edges of second top plate 106 and bottom corrugated plate 92 so as to reside parallel to long middle drip flange 98.

Adhesive insulating foam 26 serves to strengthen and insulate the roof panels 88 and 90 as well as adhesively affixing all plates, cap flanges and drip flanges into their spaced configurations.

Figure 15:
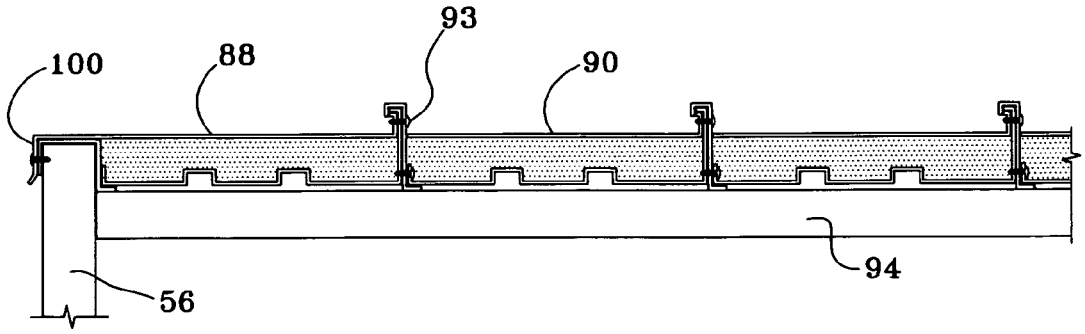
FIG. 15 is a partial cross sectional side view of a roof to wall configuration taken through the longitudinal center of the enclosure.

Looking at FIG. 15 it can be seen how inner drip flange 96, middle drip flange 98 and outer drip flange 108 nestle to form a rainproof seal. Mechanical fastener 93 connects the adjacent panels. This fastener 93 may be any of a multitude of mechanical fasteners, including but not limited to screws, bolts, pins, rivets and cinchlocks.

Looking at FIG. 11 end view cross section, it can be seen how first top plate 95 of end panel 88 extends beyond the length of corrugated panel 92 to form side drip flange 107 so as to prevent rain ingress between the roof panels and the side wall panels 111. Second top plate 106 of center panel 90 has a substantially similar side drip flange. Mechanical fasteners although not necessary to affix side drip flange 107 to top rail 94 and wall panels 56 or 68, may be used. Cap flange 100 and cap plate 102 require mechanical fasteners to affix them to end wall panels 113. Here it can also be seen that top rail 94 is a box tubular member with a "C" shaped channel projecting normally from one face and away from the edge of that face so as to form a cavity 101 adapted for insertion of an end wall panel. The area enclosed by the box tubular member of top rail 94 is used as a wire raceway eliminating the need for separate conduit.

The overall assembly is best explained by reference to end view partial cutaway FIG. 16. Enclosure 115 is a three dimensional enclosure having six planar, rectangular outer faces. Enclosure 115 is comprised of a series of connected corrugated, floor panels 20 that have a smooth bottom surface 44 adapted for direct placement upon a rooftop curb forming a peripheral boarder around a rooftop opening. This smooth bottom surface 44 allows for installation of the enclosure onto a variety of different sized curbs. Bottom rails 72 are fastened by mechanical fastener 86 onto all four sides of the floor panel assembly. These bottom rails 72 are shorter in length than the overall length of the sides of the floor panel assembly they are connected onto. All wall panels 56 are connected to one bottom rail 72, while corner panels 68 are connected to two, perpendicular bottom rails 72. Mechanical fasteners 16 are used to connect the wall panels 56 and 68 to the bottom rail 72 through the connecting and weatherproofing lip 116. The wall panels 56 and 68 are affixed substantially normal to the floor panels 20.

Wall panels 56 and corner panels 68 are mechanically fastened to whichever type of wall panel is adjacent by mechanical fasteners 66 passing through the sidewalls 58. Two top rails 94 are mechanically affixed with mechanical fasteners 110 to the top of the series of wall panels 56 and corner panels 68 that make up the two longest and parallel walls. This serves to align the wall panels in the same manner as the bottom rail 72 does and serves as a support for the roof panels 88 and 90.

The roof is made of a series of connected roof panels having end panels 88 at the end of a series of connected center panels 90. Adjacent roof panels are connected to each other by fastener 93 passing through the inner drip flange 96, middle drip flange 98 and outer drip flange 108, which nestle to form a rainproof seal. The wall panels 56 and 68 on the ends of the enclosure 115 fit into cap plate 102 and the wall panels 56 and 68 on the long wall sides of the enclosure 115 fit into the cavity 101 of the top rail 94. Side drip flange 107 partially resides atop top rail 94 so as to form another rain proof seal for the roof to wall interface. Mechanical fasteners 110 may be used to secure the roof panels 88 and 90 to the wall panels 56 and 68 and to top rail 94.

With this style of construction, a lightweight planar torsion box rooftop enclosure is established that offers exceptional strength and stability against non elastic deformation.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Having thus described the invention, what is claimed as new and desired to be secured by Letters Patent is as follows:

1. A rooftop enclosure comprising:

a rectangular metal floor system made of at least two substantially similar, adjacent, mechanically connected, interlocking floor panels;

a metal, four sided, rectangular wall system made of mechanically joined rectangular cross sectional wall panels and corner panels;

a rectangular metal roof made of two substantially similar end panels separated and connected by at least one center panel;

four steel bottom panel clips adapted for connection between said floor system and each side of said four sided wall system so as to hold and secure said corner and wall panels normal to said floor system and about an exterior perimeter of said floor system;

two metal top rails with enclosed protective channels residing on opposing walls of said wall system and adapted to support said roof panels and to connect said roof panels to said walls; and at least one mechanical fastener;

wherein said floor system has at least two panels mechanically connected so as to reside adjacent and parallel, wherein said panels are comprised of a first upper, concave, surface corrugated, linear steel member that resides atop a second, "C" shaped, concave, linear steel member such that said upper member's concavity resides within said lower member's concavity so as to form a void between said members that is filled with an adhesive, structural strengthening polymer foam, and wherein said mechanical connection of said panels is accomplished by a bolting arrangement between said adjacent second linear steel members and wherein said first member is comprised of an upper corrugated plate having a first side of a first height projecting normally from said plate and a second side of a second height extending normally from said plate such that said sides are congruent and parallel to each other, and wherein said first side has an "L" shape configured cap plate extending normally therefrom, and wherein said second side has a top plate extending normally therefrom, and wherein said first side's height exceeds said second side's height such that said L shaped cap plate resides atop of said top plate on said adjacent and parallel connected panels, wherein said second linear steel member is a linear plate with a first side and a second side extending normally therefrom so as to form a concave "C" configuration, wherein said first side has a first upper flange and said second side has a second upper flange and wherein said cap plate of said first panel resides atop said first upper flange of said first panel and said top plate of an adjacent panel and said top plate of said first panel resides atop said second upper flange of said first panel, and wherein said steel bottom panel clip has an upper rail and a lower L shaped rail each held in parallel configuration and extending normally from a first side of a side rail that has a wall support plate extending normally from a second side thereof and a wall sealing flange extending normally and downward from said wall support plate such that said wall support plate and said sealing flange form an exterior moisture proof seal with an exterior surface of a wall having a matingly configured outer lip that overlaps and is adjacent to said sealing flange when said wall resides atop of said wall support plate, and wherein said upper rail extends normally from a central location on said first side of said side rail so as to form said upper lip to form an interior moisture proof seal with an inside surface of said wall, and wherein said top rail with enclosed protective channel is a unitary boxed tubular channel, with a C shaped channel dimensionally sized to accept a thickness of said wall projecting from an edge of said tubular channel, and wherein said wall panels are constructed of an outer metal plate and an inner metal plate held in a spaced parallel planar configuration by an adhesive insulating polyurethane foam, and said corner panels are constructed of an outer plate formed at a right angle and an inner planar plate formed at a right angle and held in a spaced congruent configuration by an adhesive insulating polyurethane foam and wherein said roof end panels are constructed of a lower corrugated plate, a generally planar smooth upper plate and a U shaped side channel dimensioned to accept a wall panel and wherein said lower plate, said upper plate and said channel are held in a parallel configuration with respect to their longitudinal axes by an adhesive insulating polyurethane foam, and wherein said center panel is constructed of a lower corrugated plate, a generally planar smooth upper plate and a side drip cap plate held in parallel spacing with respect to their longitudinal axes by an adhesive insulating polyurethane foam, and wherein all adjacent panels are interlocked and mechanically connected.

* * * * *